US005462374A

United States Patent [19]

Kohno

[11] Patent Number: 5,462,374

[45] Date of Patent: Oct. 31, 1995

[54] CARD PRINTING APPARATUS

[75] Inventor: Nobuo Kohno, Kanagawa, Japan

[73] Assignee: Sony Corporation, Tokyo, Japan

[21] Appl. No.: 304,818

[22] Filed: Sep. 13, 1994

Related U.S. Application Data

[63] Continuation of Ser. No. 19,638, Feb. 18, 1993, abandoned.

[30] Foreign Application Priority Data

Feb. 25, 1992 [JP] Japan ..... 4-073186

[51] Int. Cl.[6] ..... B41J 11/58

[52] U.S. Cl. ..... 400/625; 101/44; 271/238; 414/797.8; 414/797.9; 414/798; 414/798.1

[58] Field of Search ..... 400/599.1, 601, 400/602, 624, 625, 628, 629, 630, 633, 617, 133; 101/18, 43, 44; 271/84, 237, 238, 131, 264, 267; 414/797.4, 797.8, 797.9, 798, 798.1

[56] References Cited

U.S. PATENT DOCUMENTS

| | | | |
|---|---|---|---|
| 4,457,665 | 7/1984 | Fluck | 414/798 |
| 4,507,668 | 3/1985 | Horiya et al. | 400/208 |
| 4,743,129 | 5/1988 | Keryhuel et al. | 400/630 |

FOREIGN PATENT DOCUMENTS

| | | | |
|---|---|---|---|
| 62-11370 | 1/1987 | Japan . | |
| 0053943 | 3/1989 | Japan | 271/131 |

OTHER PUBLICATIONS

Patent Abstracts of Japan, vol. 11, No. 199 (M–602), Jun. 1987.

Patent Abstracts of Japan, vol. 10, No. 14 (M–447), Jan. 1986.

Patent Abstracts of Japan, vol. 9, No. 252 (M–420), Oct. 1985.

English–language Abstract of 62–11370.

IBM Tech. Disc. Bulletin, vol. 13 No. 6 Nov. 1970 "Document Transport System", Johnson et al.

*Primary Examiner*—Ren Yan

*Attorney, Agent, or Firm*—Ronald P. Kananen

[57] ABSTRACT

A card printing apparatus for printing a graphic design on the surface of a card comprising a card stage adapted to mount a card on its upper surface. The upper surface of the card stage has two planes separated by about the card thickness. The card stage is fed along a straight linear path toward a card stock. When the card stage has reached a certain point along the path, a card is withdrawn from the card stock means so that the card is mounted onto the card stage. A thermal print head prints the graphic design on the surface of the card mounted on the card stage, and an ejector means responsive to the feeding of the card stage ejects the card mounted on the card stage to a card collection zone.

25 Claims, 12 Drawing Sheets

CARD PRINTING APPARATUS

This application is a continuation of application Ser. No. 08/019,638 filed Feb. 18, 1993, now abandoned.

BACKGROUND OF THE INVENTION

1. Field of the Invention

This invention relates to a card printing apparatus for printing a color image, a graphic design, etc. on a card (which is a general term for card-type printing medium) through a thermal image-transfer system.

2. Description of Related Art

A card printing apparatus for printing a color image on a card has been conventionally known (For example, as disclosed in Japanese Laid-open Patent Application No. 62-11370). In this card printing apparatus, plural coloring materials for print which are formed of cyan, magenta, yellow and black dyes or the like and coated on an ink ribbon so as to be arranged at an equidistant interval are successively thermally transferred onto a card so as to be superimposed on the card using a thermal print head on the basis of a color image information which is optically read out from a color photograph or the like, or a color image information which is obtained through an image pickup operation of a video camera, thereby printing a color image on the card.

In order to carry out a card printing operation in such a card printing apparatus, a card is mounted (placed) on a stage which is horizontally movable, and then is horizontally moved by the stage while the ink ribbon is pushed against the card with being heated by the thermal print head, so that a coloring material for print on the ink ribbon is thermally transferred onto the card. This process is repeated for each of the plural coloring materials of cyan, magenta, yellow, black, etc. in turn on the ink ribbon to successively superimpose these coloring materials on the card and thermally transfer a color image on the card.

Further, in the conventional card printing apparatus as described above, operations of mounting and ejecting a card on and from the stage have been manually carried out, or automatically carried out using a card mounting apparatus and a card ejecting apparatus which are provided independently of the card printing apparatus.

However, the card printing apparatus adopting the manual card mounting and ejecting operations on and from the stage is very cumbersome in its operation, and degraded in its working performance. The card printing apparatus adopting the automatic card mounting and ejecting operations on and from the stage using the card mounting and ejecting apparatuses provided independently of the card printing apparatus is complicated in construction and high in cost. In addition, this card printing apparatus is degraded in its space factor, and thus requires a large-scale structure as a whole.

SUMMARY OF THE INVENTION

An object of the invention is to provide a card printing apparatus capable of solving the above problems of the conventional card printing apparatus, in which the automatic card mounting and ejecting operations on and from the stage can be carried out.

BRIEF DESCRIPTION OF THE DRAWINGS

FIG. 12 including

DETAILED DESCRIPTION OF THE PREFERRED EMBODIMENTS

Figure 1:
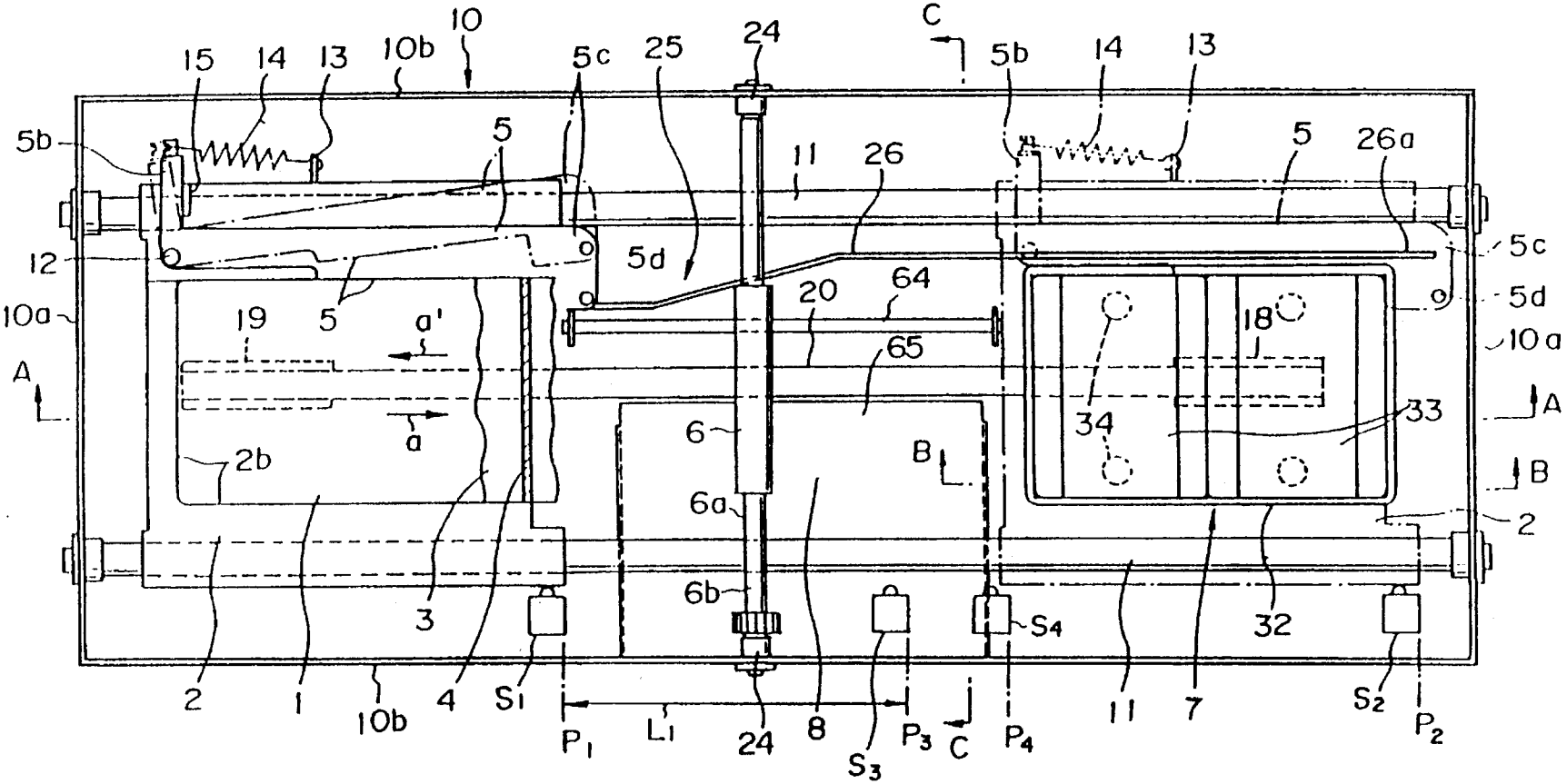
FIG. 1 is a plan view of the whole construction of a card printing apparatus according to an embodiment of this invention.

An embodiment of a card printing apparatus to which this invention is applied will be hereunder described with reference to the accompanying drawings.

FIGS. 1 to 4 are plan and cross-sectional views schematically showing the construction of the card printing apparatus of this embodiment.

The card printing apparatus of this embodiment is equipped with a stage 2 which is parallel (horizontally) movable in directions as indicated by arrows a, a' while a card-shaped printing medium, that is, a card 1 is horizontally mounted thereon, an ink ribbon 3 on which three or four printing coloring materials of cyan, magenta, yellow and black (if occasion demands) are coated at equidistant intervals, and a thermal print head 4 For heating the coloring materials to transfer them onto the card 1. In synchronism with a reciprocating horizontal (parallel) movement of the stage having the card 1 mounted thereon in the directions of the arrows a,a', the three or four coloring materials for print on the ink ribbon 3 are successively heated and thermally transferred onto the card 1 in order of cyan, magenta, yellow to black by the thermal print head 4 on the basis of a color image information while the ink ribbon 3 is pushed against the card 1. This card printing process is repeated three or four times. Through this process, the three or four coloring materials for print on the ink ribbon 3 are successively thermally transferred onto the card so as to be superimposed on the card in order of cyan, magenta, yellow to black, thereby printing a color image on the card 1 on the basis of the color image information.

In addition, the card printing apparatus is equipped with a card mounting arm 5 for freely detachably mounting the card 1 on the stage 2, and a card pushing roller 6 For elastically pushing the card 1 against the stage 2 at all times so that the card 1 is prevented from unintentionally falling off from the stage 2 during a card printing operation. Further, a card stock portion 7 for stocking unused cards 1 in tiers is disposed at a position adjacent to a card printing section L on a card feeding passageway on the stage 2. The unused cards 1 which are stocked in the card stock portion 7 can be automatically mounted on the stage 2 one by one through the horizontal movement off the stage 2 in the directions of the arrows a,a'. A card ejecting mechanism 8 is disposed between an original position $P_1$ of the stage 2 as indicated by a solid line of FIGS. 1 and 3 and the card stock portion 7, and an used card 1 after the card printing operation can be automatically ejected through the horizontal movement of the stage 2 in the direction of the arrow a'.

The details of respective parts of the card printing apparatus will be next described one by one.

Figure 5:
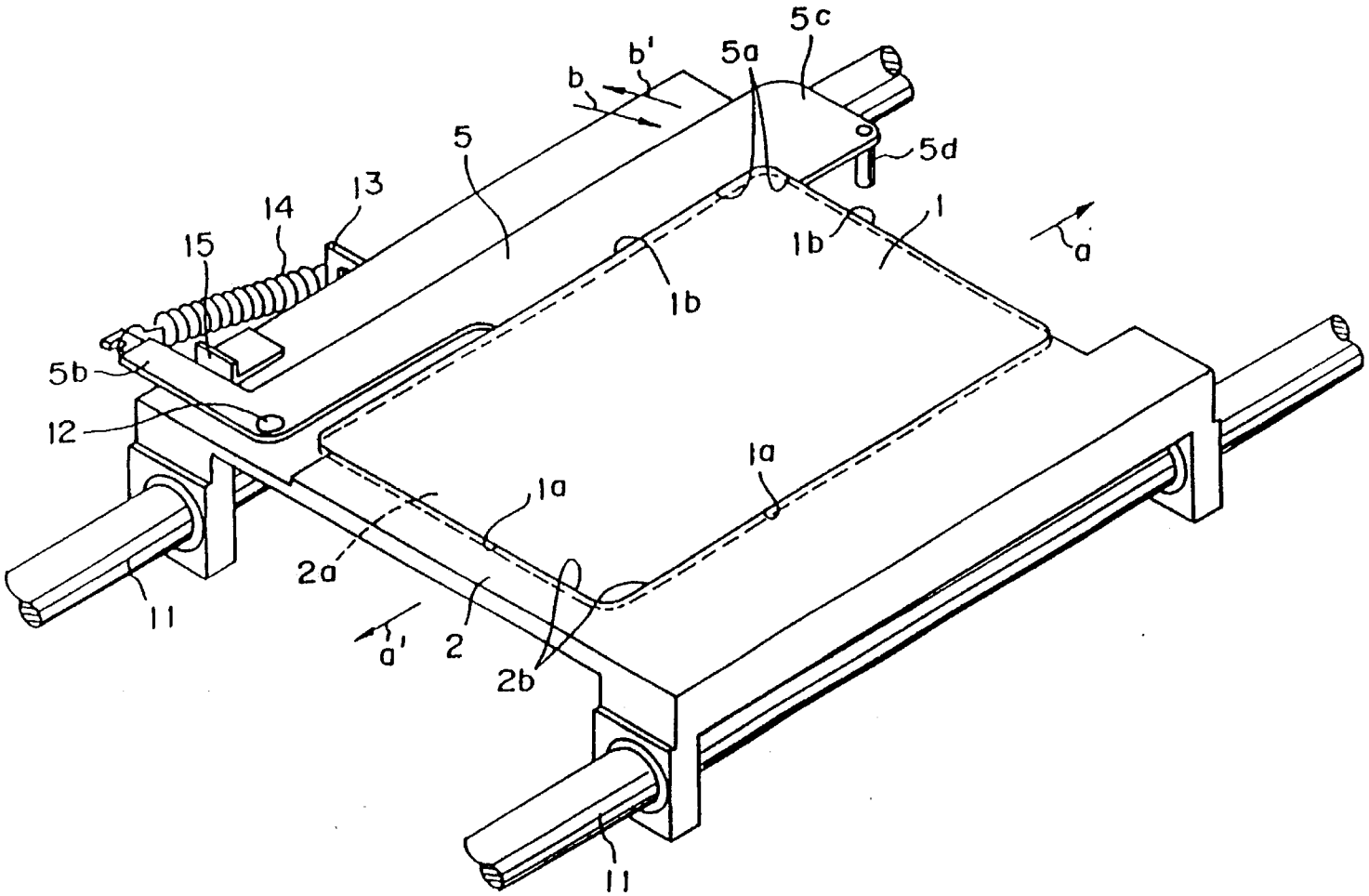
FIG. 5 is a perspective view of a stage and a card mounting arm of the card printing apparatus.
Figure 6:
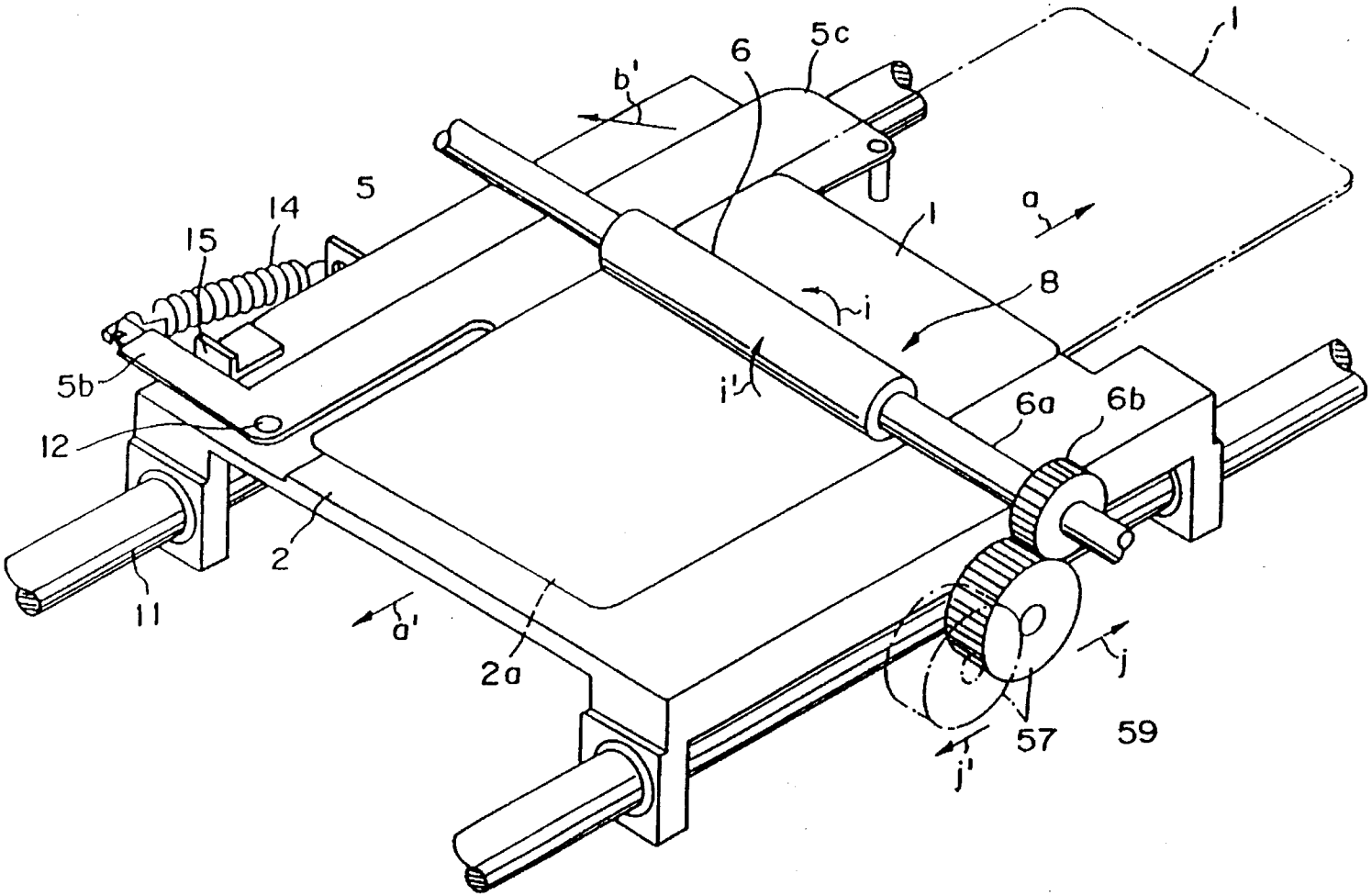
FIG. 6 is a perspective view of a card ejecting mechanism on the stage of the card printing apparatus.

FIG. 5 is a perspective view of the stage and the card mounting arm of the card printing apparatus, and FIG. 6 is a perspective view of the card ejecting mechanism on the stage of the card printing apparatus.

Figure 2:
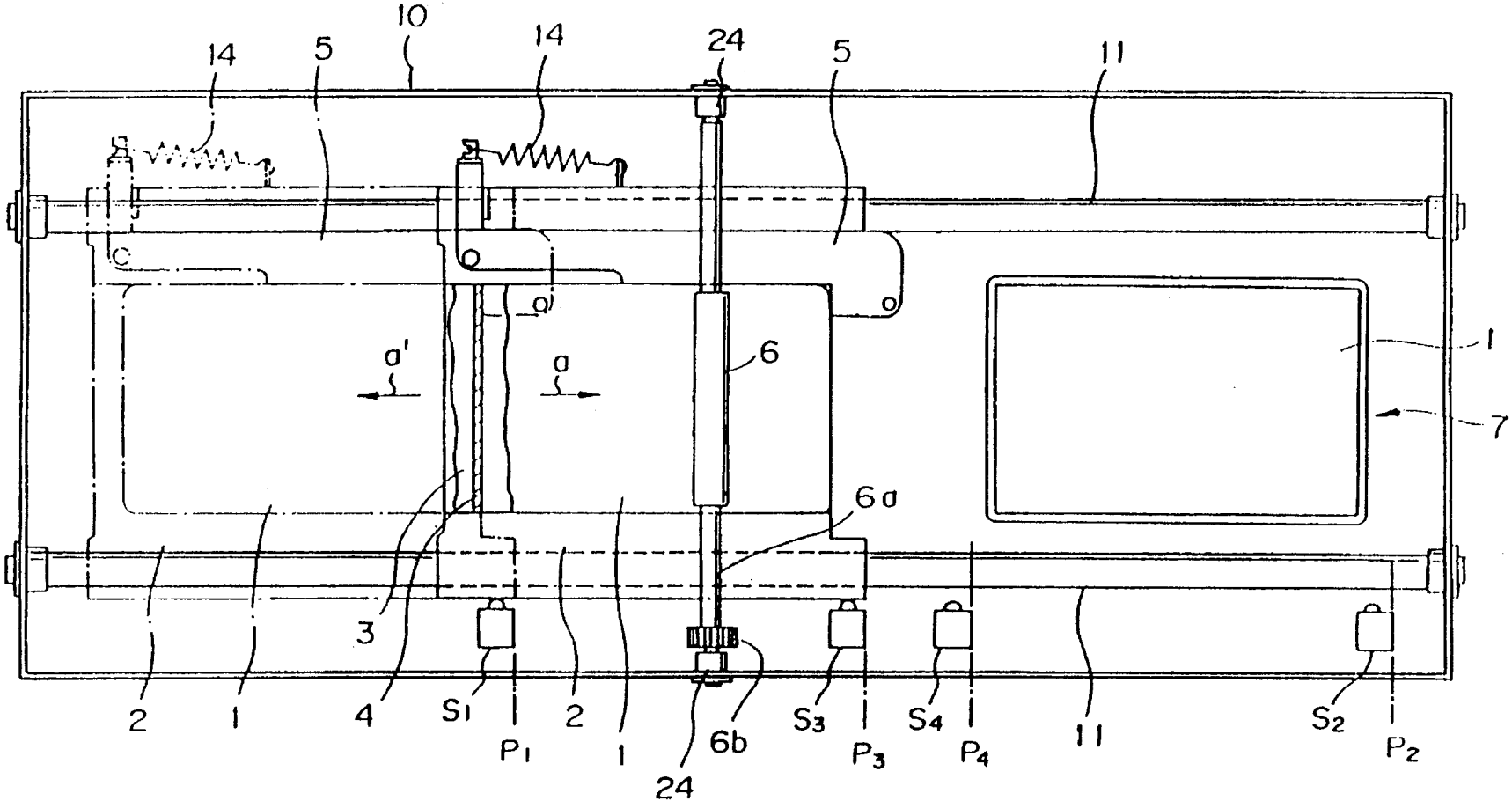
FIG. 2 is a plan view showing a printing process of the card printing apparatus.
Figure 3:
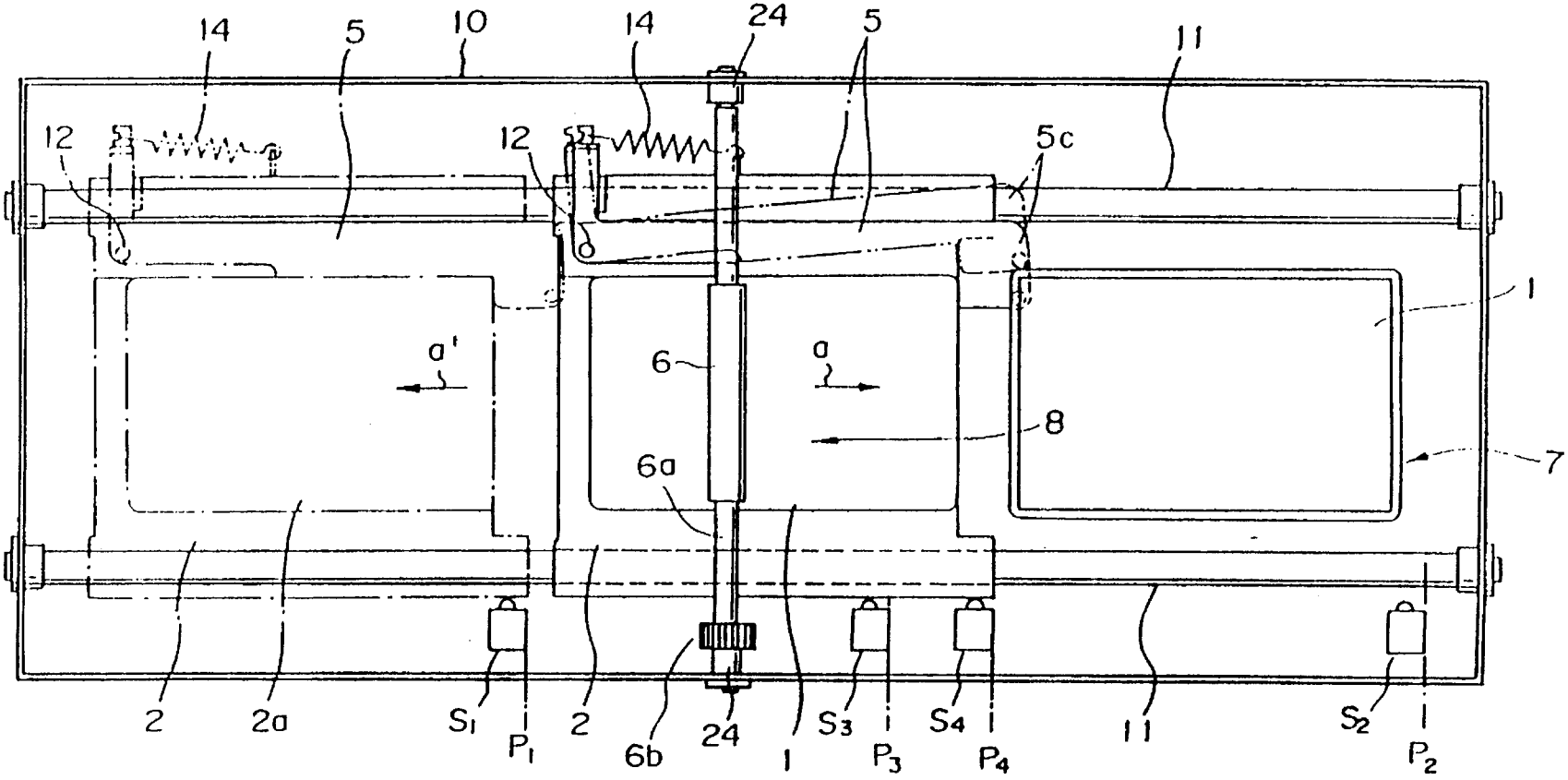
FIG. 3 is a plan view showing a card ejecting process of the card printing apparatus.

As shown in FIGS. 1 to 6, a pair of guide shafts 11 are horizontally and parallel bridged at the right and left sides in a case 10 serving also as a chassis between a pair of vertical side wall plates 10*a* of the case 10 at the front and rear sides of the case 10, and the stage 2 is guided along both of the guide shafts 11 so as to be horizontally and parallel movable in the directions of the arrows a,a' between the original position $P_1$ and a card mounting position $P_2$ below the card stock portion 7 which are indicated by solid lines of FIGS. 3 and 6. A card printing position $P_3$ and a card ejection position $P_4$ are defined between the original position $P_1$ and the card mounting position $P_2$, and the position of the stage 2 is detected with four sensors $S_1$, $S_2$, $S_3$ and $S_4$ at each of the positions $P_1$, $P_2$, $P_3$, and $P_4$.

On the upper surface of the stage 2 is formed a horizontal card mount surface 2*a*, and at one side portion of the card mount surface 2*a* is formed a vertical card reference surface 2*b* for positioning vertical two first side surfaces 1*a* of the card 1. The card reference surface 2*b* is vertically formed so as to have the height which is substantially equal to the thickness of the card 1.

The card mounting arm 5 is formed of plate material having the substantially same thickness as the card 1, and is so designed as to have a substantially L-shaped flat surface. The card mount arm 5 is secured through a vertical fulcrum pin 12 to the other side portion of the card mount surface 2*a* of the stage 2 so as lid be freely rotatable in directions as indicated by arrows of b, b' on a horizontal plane. The card mounting arm 5 is formed with a vertical card engaging surface 5*a* which is engageable with vertical two second side surfaces 1*b* of the card 1 located at the opposite side of the two first side surfaces 1*a* of the card 1. The card mounting arm 5 is rotatably urged in the direction as indicated by the arrow b by an extension spring 14 which is suspended between a free end portion 5*b* of the card mounting arm 5 and a spring engaging portion 13 formed at the side surface of the stage 2, and is so designed as to abut against a stopper 15 on the stage 2 at such a position that the card engaging surface 5*a* is in parallel to the card reference surface 2*b*. A vertical guide pin 5*d* is secured to the lower surface of the tip 5*c* of the card mounting arm 5.

A stage driving mechanism 17 includes a pair of front and rear pulleys 18 and 19 which are disposed at a lower side between the guide shafts 11 in the case 10, a belt 20 which is suspended between the pulleys 18 and 19 so as to be in parallel to the guide shafts 11 and a motor 21 for driving the pulley 18 to rotate, and a part of the upper portion of the belt 20 is fixed to a central lower portion of the stage 2 through a belt fixing member 22.

The card pushing roller 6 is horizontally disposed at a substantially center position of the card printing section $L_1$ on the moving passageway of the stage 2 so as to be vertical to the guide shafts 11. The card pushing roller 6 is formed of a member having large Friction coefficient and proper elasticity such as rubber or the like, and fixedly secured to the outer peripheral surface of a horizontally-disposed roller shaft 6*a* which is freely rotatably secured through a pair of bearings 24 to a pair of right and left side surface plates 10*b* of the case 10. The card pushing roller 6 is so designed as to elastically push the card 1 mounted on the card mount surface 2*a* of the stage 2 from the upper side. A gear 6*b* is fixed to one end of the roller shaft 6*a*.

A guide mechanism 25 for guiding the guide pin 5*d* in such a manner that the card mounting arm 5 is opened and closed in the directions of the arrows b, b' is provided as shown in FIGS. 1 and 2. As shown in FIG. 3, the guide mechanism 25 includes a guide rail 26 which is horizontally disposed between the original position $P_1$ and the card mounting position $P_2$ along the moving passageway of the guide pin 5*d* in the directions of the arrows a, a'. The guide rail 26 is secured through a bracket 28 to a fulcrum shaft 27 disposed in parallel to both of the guide shafts 11 in the case 10 so as to be Freely rotatable in the directions of the arrows c, c', and a control arm 30 is linked to the eccentric position of the bracket 28 through a pin 30.

Figure 7:
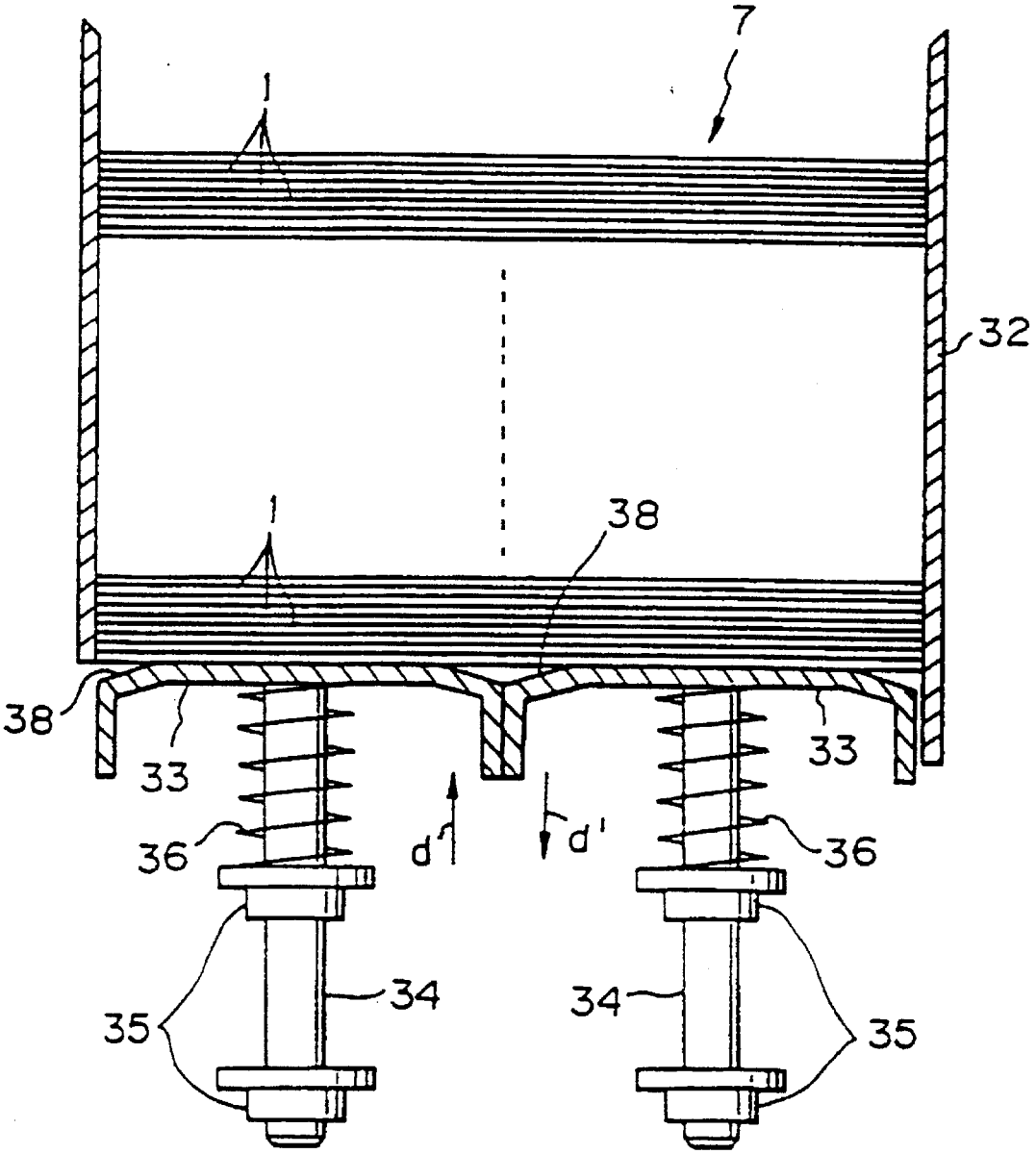
FIG. 7 is a cross-sectional view of the card printing apparatus which is taken along a line B—B as shown in FIG. 3, and showing a card stock portion of the card printing apparatus.
Figure 8:
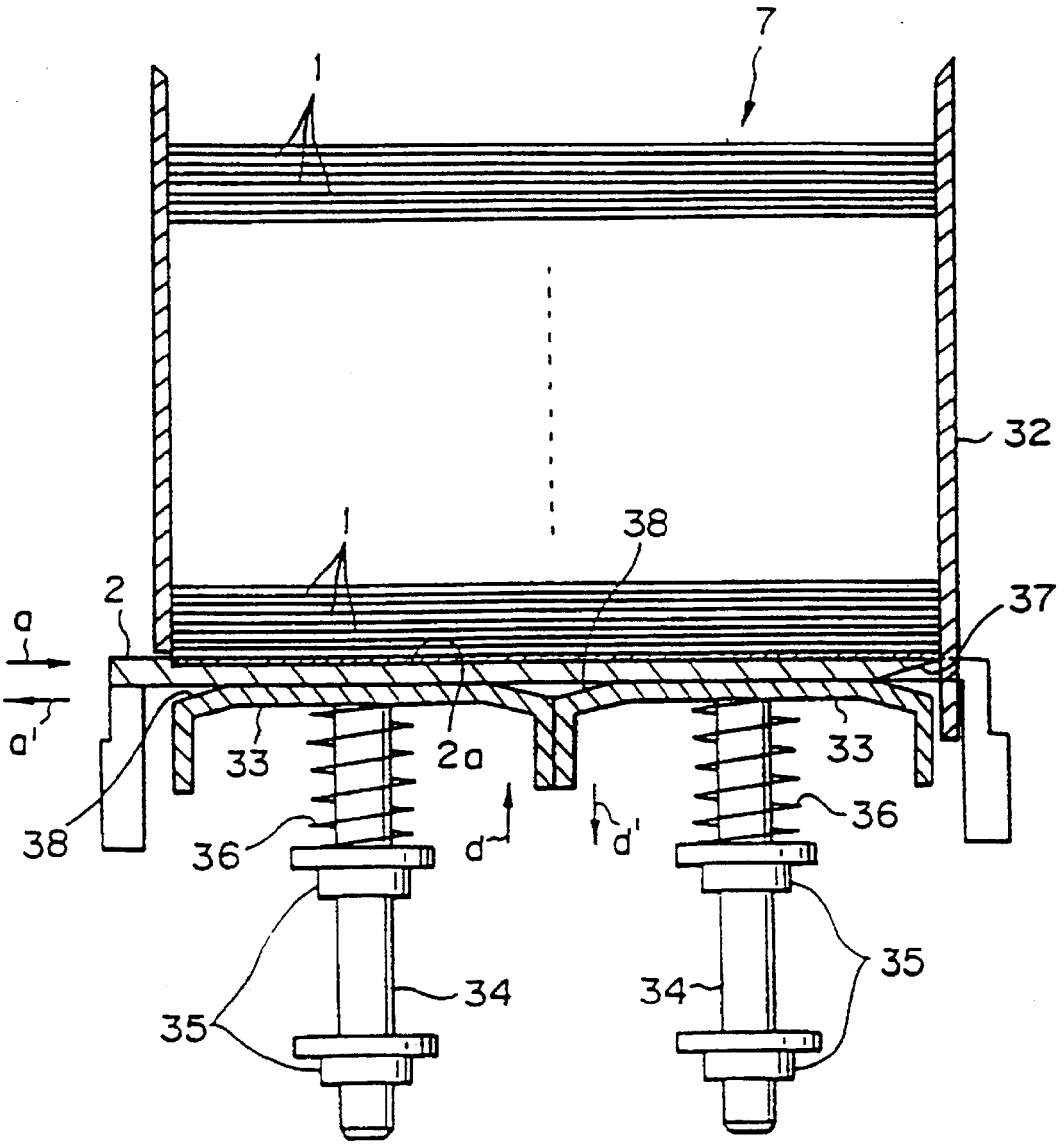
FIG. 8 is the same cross-sectional view as FIG. 7, which shows an automatic mounting operation of the card on the stage in the card stock portion.

As shown in FIGS. 1 to 4 and FIGS. 7 and 8, the card stock portion 7 has a rectangular-shaped card accommodating frame 32 which is vertically erected in the case 10 anti whose upper and other sides are opened, and a pair of vertically-movable bisectional bottom plates 33 at the front and rear sides in the card accommodating frame 32. A number of unused cards 1 are horizontally accommodated on the bottom plates 33 in the card accommodating frame 32 while vertically piled tip. Each of a pair of support shafts 34 which are vertically secured to the lower surfaces of the pair of front and rear bottom plates respectively is penetrated through a pair of upper and lower bearings 35 so as to be freely ascendable and descendible in directions as indicated by arrows d, d' which correspond to the upward and downward directions. Each bottom plate is upwardly urged in the direction of the arrow d by a compression spring 36 which is engaged around the outer periphery of the upper end of each support shaft 34. As shown in FIG. 8, a guide surface 37 which is a slant surface directing slantly downwardly is formed on an end surface of the card mount surface 2*a* of the stage 2 at the side of the direction of the arrow a, and a guide surface 38 which is a slant surface directing slantly upwardly is formed at each end surface of the pair of the bottom plates 33 at the side of the direction of the arrow a'.

Figure 4:
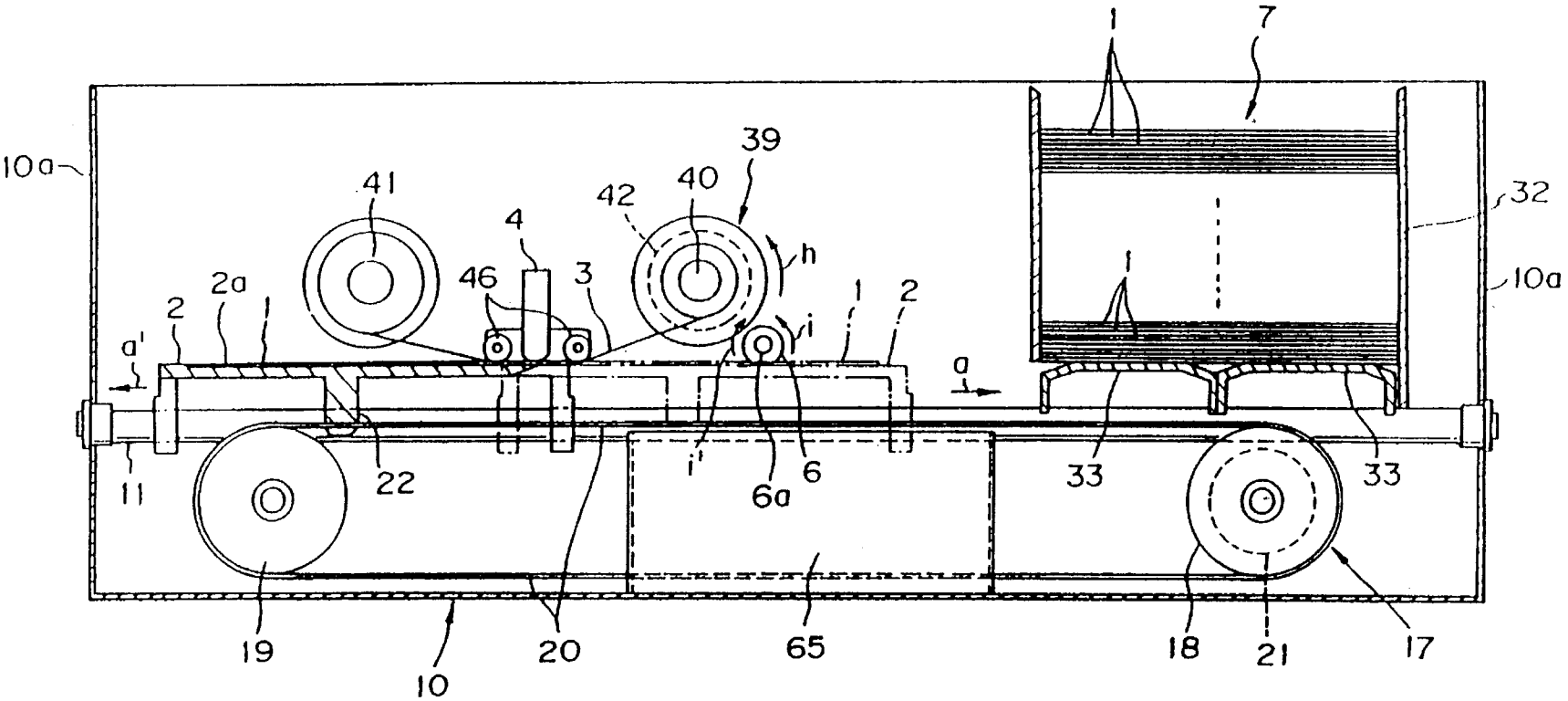
FIG. 4 is a cross-sectional view of the card printing apparatus which is taken along a line A—A as shown in FIG. 3.
Figure 9:
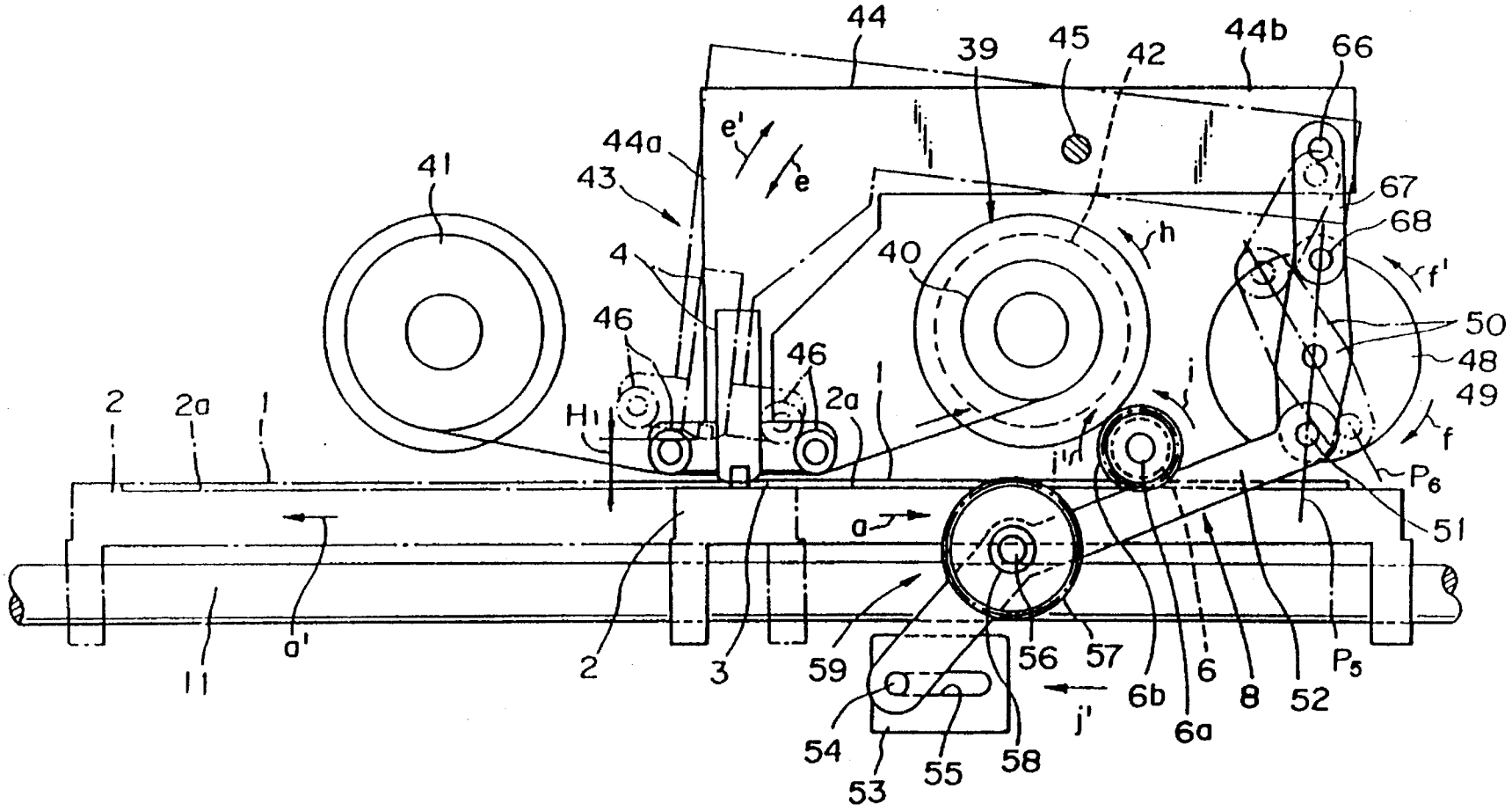
FIG. 9 is a side view showing a head ascending and descending mechanism and a card ejecting mechanism of the card printing apparatus.
Figure 10:
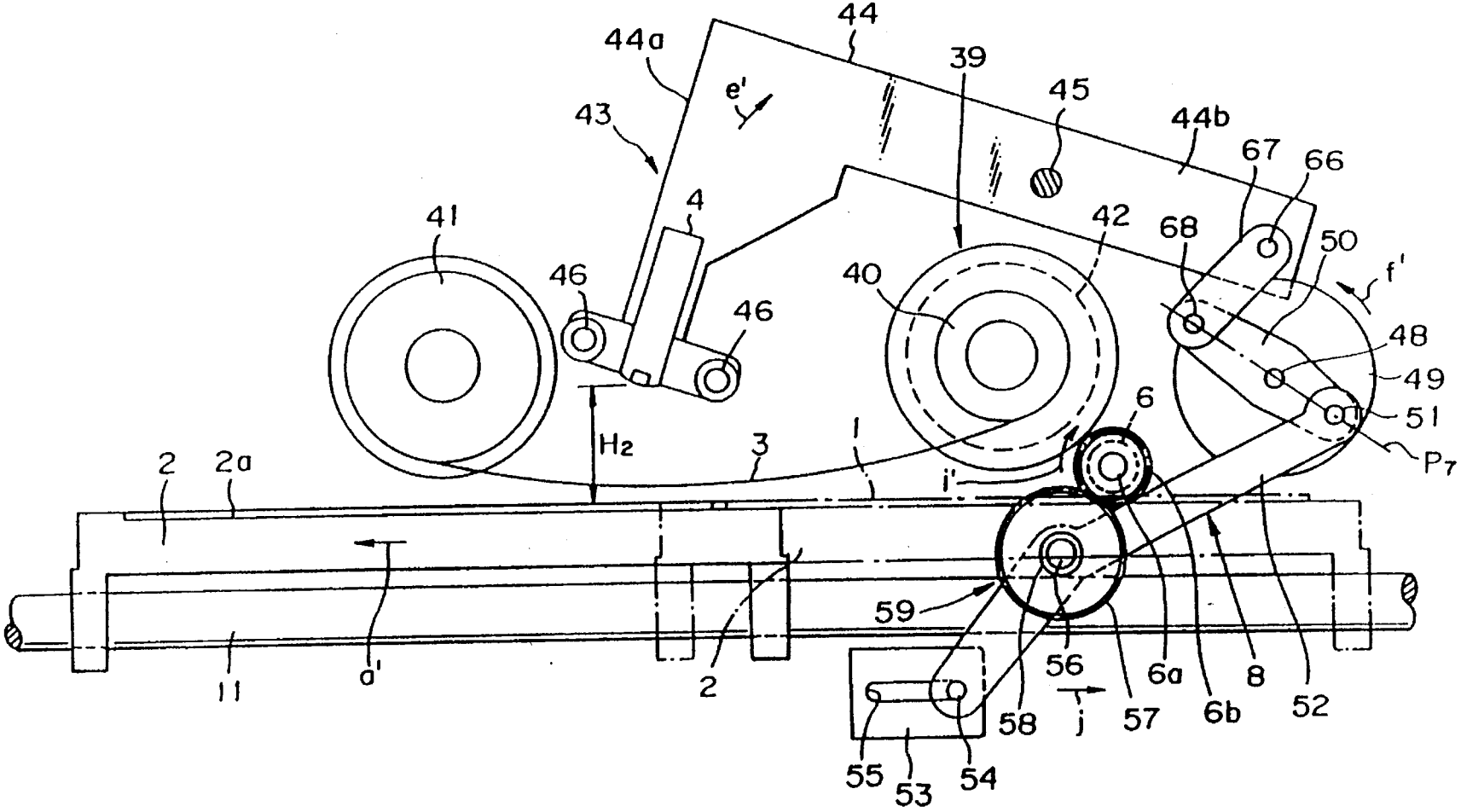
FIG. 10 is a side view showing a card ejection operation of the card ejection mechanism.

As shown in FIGS. 4, 9 and 10, the ink ribbon 3 is disposed above the moving passageway of the stage 2 so as to be in parallel to the longitudinal direction of both of the guide shafts 11. An ink ribbon wind-up mechanism 39 for intermittently winding tip the ink ribbon 3 has a pair of front and rear wind-up drums 40 and 41 which are freely rotatably disposed between the pair off right and left side surface plates 10*b* of the case 10 at the front and rear positions of the original position $P_1$, and both ends of the ink ribbon 3 are wound around the pair of wind-up drums 40 and 41. One of the wind-up drums, that is, the wind-up drum 40 is intermittently rotated by a motor 43 or the like.

As shown in FIGS. 4. 9 and 10, the thermal print head 4 is vertically disposed at the substantially central portion between the pair of front and rear wind-up drums 40 and 41 in such a manner as to be contacted with the ink ribbon 3 from the upper side. A head ascending and descending mechanism 43 for ascending and descending the thermal print head 4 is provided with a head arm 44 having an L-shaped side surface which is formed by a vertical arm portion 44*a* and a horizontal arm portion 44*b*, and the head arm 44 is so designed as to be freely rotatable in directions as indicated by arrows e, e' around a fulcrum shaft 45 which is horizontally disposed between the upper portions of the pair of right and left side plates 10*b* of the case 10. The thermal print head 4 is vertically secured to the lower end of the vertical arm portion 44*a* of the head arm 44, and a pair of horizontal rollers 46 for preventing attachment of the ink ribbon 3 to the thermal print head 4 are parallel secured at both of front and rear sides of the thermal print head 44 in the directions of the arrows a, a'.

As shown in FIGS. 6, 9 to 11, the card ejection mechanism 8 includes a driving shaft 48 which is horizontally disposed between the upper portions of the pair of right and left side plates 10*b* of the case 10, a motor 49 for forwardly and reversely rotating the driving shaft 48 in directions as indicated by arrows f, f', a driving lever 50 fixed to the driving shaft 48, a control arm 52 whose upper end is linked through a pin 51 to the lower end of the driving lever 50, and an elongated hole 55 which is horizontally formed in a bracket 53 fixed to the side plate 10*b* of the case 10 and through which a guide pin 54 secured to the lower end of the control arm 52 is guided. A rotation control mechanism 59 includes a gear 57 secured around the outer periphery of a non-rotational support shaft fixed to the control arm 52 and an unidirectional rotation restricting means 58 such as an unidirectional clutch, a ratchet or the like, and through the engagement and detachment between the gear 57 and the gear 6*b* fixed to the end portion of the roller shaft 6*a* of the card pushing roller 6, the rotation control mechanism 59 serves to control the card pushing roller 6 to be kept to a free-rotational state and a rotation-stop state.

Adjacently to an area from the card ejection position $P_4$ to the original position $P_1$, a card ejection rod 64 is horizontally provided in parallel to both of the guide shafts 11 below the moving passageway of the stage 2, and a card ejection plate 65 is disposed so as to be downwardly slant at one side. The lower end of the card ejection plate 65 is connected to a card ejection port 66 which is formed at the one side plate 10*b* of the case 10.

The driving shaft 48, the motor 49 and the driving lever 50 also function as a driving source For the head ascending and descending mechanism 43, and the free end portion of the horizontal arm portion 44*b* off the head arm 44 and the driving lever 50 are linked to each other through a link 67 and a pair of pins 66 and 68. The control arm off the guide mechanism 25 as shown in FIG. 12 is so designed as he be moved in directions as indicated by arrows g, g' substantially in synchronism with the rotation of the driving lever 50 in the directions of the arrows f, f'.

Next, the operation of the card printing apparatus thus constructed will be described in details.

[Card Automatically-mounting Operation]

First, before a card is mounted on the stage 2, as indicated by a one-dotted chain line of FIG. 9, the driving lever 50 of the head ascending and descending mechanism 43 is rotated in the direction of the arrow f' from its original position $P_5$ to a first rotation position $P_6$ by a small angle, and the head arm 44 is rotated in the direction of the arrow e' through the link 67, so that the thermal print head 4 is ascended in an upward direction of the stage 2 by a small height H.

Figure 12A:
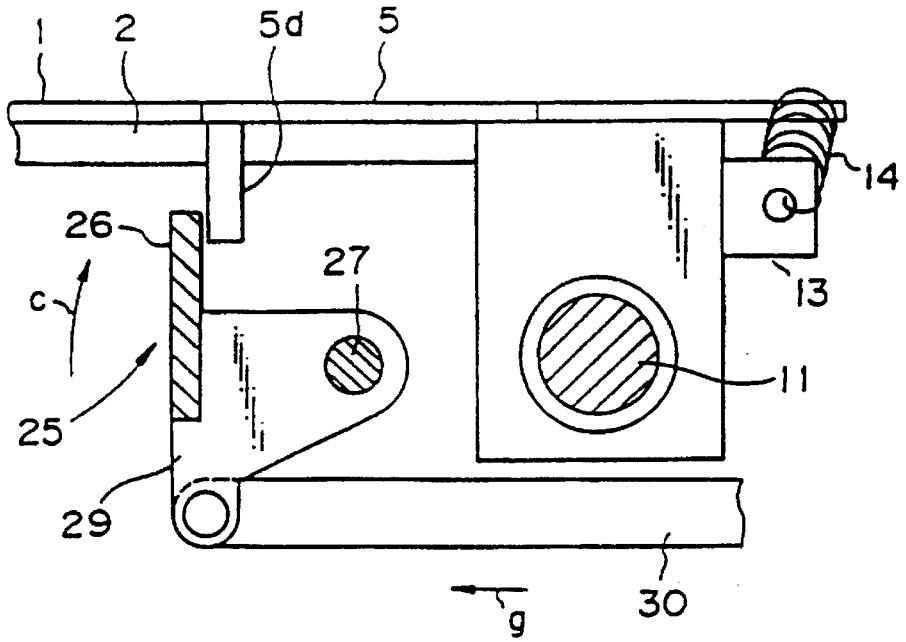
FIGS. 12(A) and 12(B) is a cross-sectional view of the card printing apparatus which is taken along a line D—D of FIG. 3 and showing an inversion operation of a guide mechanism of the card mounting arm of the card printing apparatus.
Figure 12B:
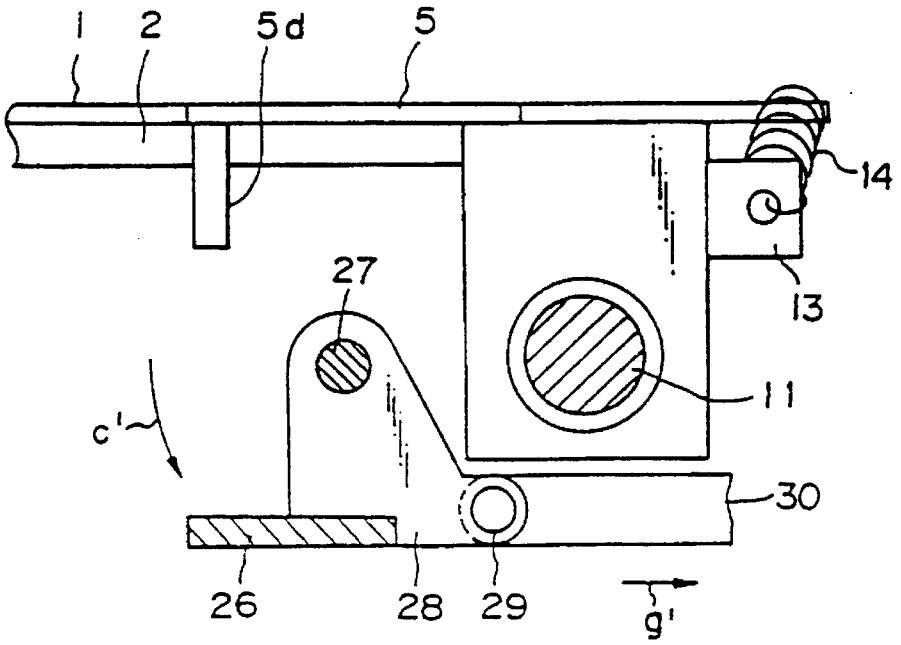

As shown in FIG. 12(A), the control arm 30 of the guide mechanism 25 is moved in the direction of the arrow g, and the guide rail 26 is rotated in the direction of the arrow c by 90° integrally with the bracket 28, so that the guide rail 26 is vertically erected to its operating position adjacent to the guide pin 5*d* to guide the guide pin 5*d* of the card mount arm 5.

When the card is mounted on the stage, the belt 20 of the stage driving mechanism 17 as shown in FIGS. 1 and 4 is rotated in the direction of the arrow a through the pulley 18 by the motor 21, and the stage 2 is parallel moved from the original position $P_1$ as indicated by a solid line of FIG. 1 to the card mount position $P_2$ as indicated by a one-dotted chain line of FIG. 1 by the belt 20, thereby inserting the stage 2 into a lower side of an unused card 2 at the lowermost stage of the card stock portion 7 from the direction as indicated by the arrow a as shown in FIG. 8.

At this time, as the stage 2 is guided by both of the guide shafts 11 so as to be moved in the direction of the arrow a, as shown in FIGS. 1 and 12(A), the guide rail 26 of the guide mechanism 25 guides the guide pin 5*d* of the card mounting arm 5 in the direction of the arrow b', so that the card mounting arm 5 is rotated from the position as indicated by the solid line of FIG. 3 to the position as indicated by the one-dotted chain line against the extension coil spring 14.

Therefore, the stage 2 is inserted into the lower side of the unused card 1 at the lowermost stage from the direction of the arrow a as shown in FIG. 8 in a state where the card mounting arm 5 is released to the outside (the side of the direction of the arrow b') of the unused card at the lowermost stage in the card stock portion 7.

At this time, the guide surface 37 of the stage 2 abuts against the guide plates 38 of the pair of bottom plates 33 of the card stock portion 7 in turn from the direction of the arrow a, so that the bottom plates 33 are pushed against the pair of compression coil springs 36 in a downward direction (the direction of the arrow d'), and the stage 2 is inserted into the lower side of the unused card at the lowermost stage from the direction or the arrow a. Through the insertion of the stage 2, the unused card 1 at the lowermost stage is automatically horizontally mounted on the card mount surface 2*a* off the stage 2.

Thereafter, when the insertion of the stage 2 into the lower side of the unused card 1 at the lowermost stage is completed as shown in FIG. 8, the guide pin 5d of the card mounting arm 5 is released from the tip 26*a* of the guide rail 26 in the direction of the arrow a' to the direction of the arrow,: a, so that the card mounting arm 5 is rotated and returned in the direction of the arrow b by the extension coil spring 14.

Therefore, as shown in FIG. 5, the vertical card engaging surface 5*a* of the card mounting arm 5 abuts against the vertical second side surface 1*b* of the unused card 1 at the lowermost stage, and the two vertical first side surfaces 1*a* of the unused card 1 is pushed against the vertical card reference surface 2*b* of the stage 2 from the direction of the arrow b by the spring force of the extension coil spring 14. Therefore, the unused card 1 at the lowermost stage, horizon-tally mounted on the card mount surface 2*a* of the stage 2, is sandwiched and held from all directions.

When it is detected by the sensor $S_1$ that the stage 2 reaches the card mount position $P_2$ as indicated by a one-dotted chain line in FIG. 3, the motor 21 as shown in FIG.

4 is stopped once and then it is reversely rotated so that the belt 20 is reversely rotated in the direction of the arrow a' through the pulley 18.

Through this operation, the stage 2 is returned from the card mount position $P_2$ to the original position $P_1$ in the direction of the arrow a', and the unused card 1 at the lowermost stage which is held on the stage 2 is taken out in the direction of the arrow a' from the inside of card stock portion 7 together with the stage 2.

After the unused card 1 at the lowermost stage is taken out, as shown in FIG. 7, the pair of bottom plates 33 are upwardly returned in the direction of the arrow d by the pair of compression coil springs 36 respectively, and all the unused cards 1 which are accommodated in the card stock portion 7 in tiers are supported from the lower side by the bottom plates 33.

On the other hand as shown in FIG. 9 on the basis of the detection of the sensor $S_2$, the driving lever 50 of the head ascending and descending mechanism 43 is returned from the first rotation position $P_6$ to the original position $P_5$ in the direction of the arrow f' by the motor 49, the control arm 30 off the guide mechanism 25 is returned in the direction of the arrow g', the guide rail 26 is rotated in the direction off the arrow c' by 90° integrally with the bracket 28, and the guide rail 26 is downwardly released to a retraction position which does not interfere with the guide pin **5*d* off the card mount arm 5**.

Thereafter, as indicated by the solid line in FIG. 9, the driving lever 50 is returned from the first rotation position $P_6$ to the original position $P_5$ in the direction of the arrow f, whereby the head arm 44 is returned in the direction of the arrow e and the thermal print head 4 is descended in the direction of the arrow e. Substantially simultaneously with the return of the stage 2 to the original position $P_1$, the thermal print head 4 downwardly pushes the end portion of the unused card 1 on the stage 2 in the direction side of the arrow a at the substantially central portion between the pair of wind-up drums 40 and 41 of the ink ribbon 3.

The return of the stage 2 to the original position $P_1$ as indicated by the solid line of FIGS. 1 and 4 is detected by the sensor $S_1$, so that the motor 21 of the stage driving mechanism 17 is stopped, and a series of card automatically-mounting operations are completed.

[Card Printing Operation]

In a first card printing process for a card printing operation, as shown in FIGS. 2, 4 and 9, in a state where the ink ribbon 3 is pushed against the end portion of the card 1 on the stage 2 in the direction side of the arrow a while heated by the thermal print head 4, the stage 2 is driven in the direction of the arrow a by the belt 20 of the stage driving mechanism 17 to move the card 1 from the original position $P_1$ to the card printing position $P_3$ in the direction of the arrow a in parallel. In synchronism with this movement, the one wind-up drum 40 is intermittently rotated in the direction of the arrow h at a fixed pitch by the motor 43 of the ink ribbon wind-up mechanism 39 or the like to intermittently wind up the ink ribbon 3 at the same pitch as the interval of the respective coloring materials for print.

Through this first card printing process, a coloring material of the ink ribbon 3, for example, a cyan material is thermally transferred onto the card 1.

When it is detected by the sensor $S_3$ that the stage 2 arrives at the card printing position $P_3$, the belt 20 of the stage driving mechanism 17 is stopped, and the driving lever 50 of the head ascending and descending mechanism 43 is rotated in the direction of the arrow f' from the original position $P_5$ to the first rotation position $P_6$ by the motor 49, so that the head arm 44 is rotated in the direction of the arrow e' and the thermal print head 4 is ascended from the position adjacent to the upper surface of the card 1 in the upward direction, that is, the direction of the arrow e'. Subsequently, the belt 20 of the stage driving mechanism 17 is reversely rotated to return the stage 2 from the card printing position $P_3$ to the original position $P_1$ in the direction of the arrow a', and then the driving lever 50 of the head ascending and descending mechanism 43 is returned in the direction of the arrow f from the first rotation position $P_6$ to the original position $P_5$, so that the thermal print head is returned to the state where it pushes the ink ribbon 3 against the end portion of the card 1 on the stage 2 in the direction side of the arrow a again. Through this operation, the first card printing process is completed.

The card printing process as described above is repeated three or four times in total for each of the coloring materials for print of magenta, yellow and black (if occasion demands), whereby the three or four coloring materials for print of the ink ribbon 3 are thermally transferred onto the card 1 in order of cyan, magenta, yellow and black to print a color image on the basis of the color image information.

[Operation of Card Pushing Roller]

In the card printing operation as described above, as shown in FIGS. 2, 4, 6 and 9, the card pushing roller 6 is freely rotatable in the directions as indicated by arrows f, f', following the reciprocating motion of the card 1 in the directions of the arrows a, a' by the stage 2, in a state where it elastically pushes the card 1 against the card mount surface **2*a* of the stage 2** from the upper side at all times.

Therefore, in each of the three or four-times card printing processes, after the thermal print head 4 is ascended (separated) from the card 1 in the direction of the arrow e', even if the ink ribbon 3 is attached to the card 1 when the card 1 is returned in the direction of the arrow a' from the card printing position $P_3$ to the original position $P_1$ by the stage 2, the card 1 is surely pushed against the stage 2, and thus the ink ribbon 3 is surely detached from the card 1 and the card 1 can be surely returned to the original position $P_1$ integrally with the stage 2. That is, the unintentional fall-off of the card 1 from the stage 2 due to the attachment of the ink ribbon 3 and the card 1 can be surely prevented by the card pushing roller 6.

Illustratively, the card pushing roller 6 is disposed at only one side of the thermal print head 4 in the direction side of the arrow a. However, a pair of card pushing rollers may be disposed at both sides of the thermal print head in the directions of the arrows a, a'. Further, pressuring springs may be secured to both ends of the roller shaft **6*a* so that the card pushing roller 6 are elastically compulsorily pushed under pressure against the card 1** by the pressuring springs.

As shown in FIG. 9, the pair of front and rear rollers 46 which are disposed at the front and rear sides of the thermal print head 4 are ascended and descended in the directions of the arrows e, e' integrally with the thermal print head 4 by the head arm 44. The pair of these rollers 46 surely prevents the attachment between the thermal print head 4 and the ink ribbon 3.

[Card automatically-ejecting operation]

When a printed card 1 on the stage 2 is automatically ejected after the end of the card printing operation as described above, as shown in FIGS. 3, 6 and 10, the stage 2 is driven in the direction of the arrow a by the belt 20 of the stage driving mechanism 17 to parallel move fine printed card 1 from the original position $P_1$ to the card ejecting position $P_4$ in the direction of the arrow a, so that the card pushing roller 6 is approached to the end portion side of the printed card 1 at the direction side of the arrow a'.

Therefore, the sensor $S_4$ detects the arrival off the stage 2 at the card ejecting position $P_4$, and the belt 20 of the stage driving mechanism 17 is stopped. At the same time, as shown in FIG. 10, the driving lever 50 is rotated in the direction of the arrow f' by a large angle so as to be passed from the original position $P_5$ through the first rotation position $P_6$ to the second rotation position $P_7$. The head arm 44 of the head ascending and descending mechanism 43 is rotated in the direction of the arrow e' so that the thermal print head 4 is upwardly ascended from the stage 2 by a large height $H_2$.

As shown in FIG. 10, when the driving lever 50 is rotated to the second rotation position $P_7$ in the direction of the arrow f', the control arm 52 of the card ejecting mechanism 8 is pulled in the direction of the arrow f', and the control arm 52 is parallel moved in the direction as indicated by an arrow j by a large distance while guided by the elongated hole 55 and the guide pin 54, so that the gear 57 of the rotation control mechanism 59 is engaged with the gear *6b* which is fixed to the roller shaft *6a* as shown in FIGS. 6 and 10.

Subsequently, by the unidirectional rotation restricting means 58 interposed between the support shaft 56 and the gear 57, the card pushing roller 6 is locked through the gears 57, *6b* and the roller shaft *6a* to the rotation-stop state where the rotation of the card pushing roller 6 in the direction of the arrow i' is prohibited.

Thereafter, on the basis of the detection of the sensor $S_4$, the belt 20 of the stage driving mechanism 17 is reversely rotated, and the stage 2 is returned from the card ejecting position $P_4$ to the original position $P_1$ in the direction of the arrow a'.

Therefore, as shown in FIGS. 6 and 10, in the state where the rotation of the card pushing roller 6 in the direction of the arrow i' is prohibited, the stage 2 is parallel moved in the direction of the arrow a', and the printed card 1 is automatically ejected from the card mount surface *2a* of the stage 2 in the direction of the arrow a by the friction of the card pushing roller 6 and the printed card 1 while the card mounting arm 5 is pushed against the extension coil spring 14 and opened in the direction of the arrow b'.

In this embodiment, the card is ejected by preventing rotation of the roller (6). Alternatively, the card can be ejected by compulsorily rotating the roller in a direction which ejects the card on the card stage to the card collection zone.

Figure 11:
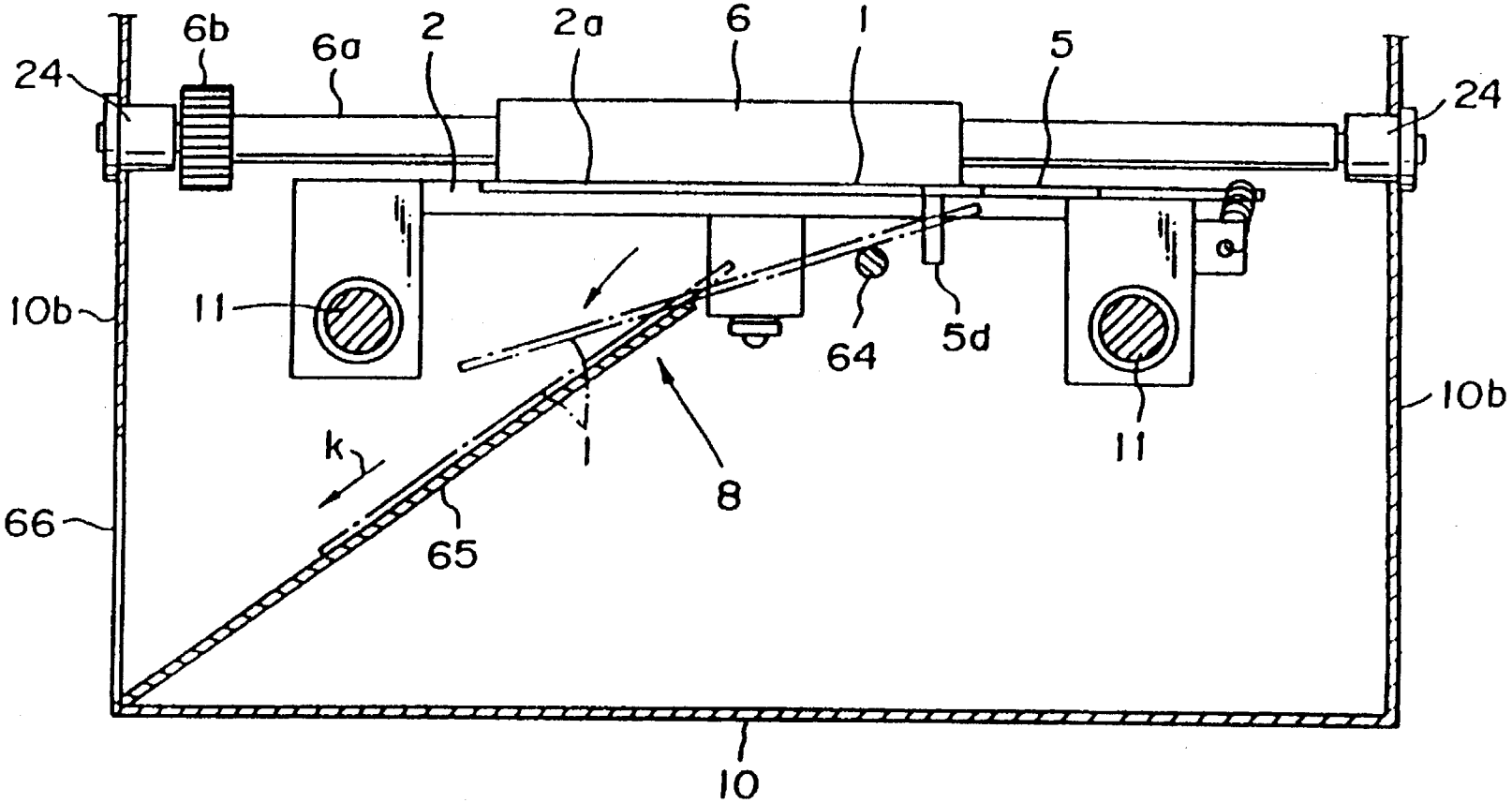
FIG. 11 is a cross-sectional view of the card printing apparatus which is taken along a line C—C of FIG. 3.

Therefore, as shown in FIG. 11, the printed card 1 which is automatically ejected from the stage 2 abuts against the card ejecting rod 64, and falls down onto the card ejection plate 65. The printed card 1 is slip in the card ejection plate 65 in the direction of the arrow k and ejected to the card ejection port 66.

As shown in FIG. 3, when the return of the stage 2 to the original position $P_1$ is detected by the sensor $S_1$, the belt 20 of the stage driving mechanism 17 is stopped, and the driving lever 50 is returned to the original position $P_5$ in the direction of the arrow f by the motor 49 as indicated by the solid line in FIG. 9. Through this operation, the control arm 52 is parallel moved in the direction of the arrow j', and the gear 57 of the rotation control mechanism 59 is separated from the gear *6b* of the roller shaft *6a*, so that the card pushing roller 6 is returned to a freely-rotational state where it an be freely rotatable in both directions of the arrows i,i'.

Illustratively, the unidirectional rotation restricting means 58 of the rotation control mechanism 59 is interposed between the support shaft 56 and the gear 57. However, the unidirectional rotation restricting means 58 may be interposed between the roller shaft *6a* and the gear *6b* provided freely rotatably to the outer periphery of the roller shaft *6a* and the gear 57 may be fixed to the support shaft 56. In this case, when the nonrotational gear 57 is engaged with the gear *6b*, the rotation of the card pushing roller 6 in the direction of the arrow i' is prohibited by the unidirectional rotation restricting means 58.

This invention is not limited to the above embodiment, and various modifications may be made on the basis of the technical idea of this invention without departing from the subject matter of this invention.

What is claimed is:

1. A card printing apparatus for printing a graphic design on the surface of a card, comprising:

a card stage adapted to mount a card on the upper surface of the card stage;

feeding means for feeding said card stage along a straight linear path being parallel to the upper surface thereof;

card stock means for stocking a plurality of cards;

means responsive to the feeding of said card stage for withdrawing one card at a time from said card stock means so that a card is mounted onto said card stage;

printing means for printing the graphic design on the surface of the card mounted on said card stage; and ejector means responsive to the feeding of said card stage for ejecting the card mounted on said card stage to a card collection zone, wherein the upper surface of said card stage comprises a first plane surface operative to receive the card thereon and a second plane surface aligned parallel to said first plane surface and extending along at least two adjoining sides of said card, and spaced at a distance from said first plane surface which is substantially equal to a thickness of the card.

2. The card printing apparatus according to claim 1, wherein said printing means comprises a thermal print head, and a thermal transfer sheet bearing thermally transferrable printing material on the surface thereof and passing between said thermal print head and said card stage.

3. The card printing apparatus according to claim 2, wherein said printing means further comprises a thermal print head transfer means for transferring said thermal print head between a first position where said thermal print head presses said thermal transfer sheet so as to contact said thermal transfer sheet to the card mounted on said card stage and a second position where said thermal transfer head is apart from said thermal transfer sheet.

4. The card printing apparatus according to claim 2, wherein said thermal print head has at least one row of thermal elements being aligned with an axis perpendicular to the straight linear path.

5. The card printing apparatus according to claim 1, wherein said withdrawing means has an arm operative to move between a first position where the arm on said card stage does not move along said straight linear path against said card and a second position where the arm is allowed to move along said straight linear path against said card.

6. The card printing apparatus according to claim 5, wherein said arm is installed on said card stage.

7. The card printing apparatus according to claim 6, wherein said arm is moved in response to the feeding of said card stage.

8. The card printing apparatus according to claim 5, wherein a thickness of said arm is substantially equal to the thickness of the card.

9. The card printing apparatus according to claim 8, wherein said arm moves between said first position and said second position staying parallel to said first plane surface.

10. The card printing apparatus according to claim 9, wherein the upper surface of said card stage further comprises a vertical card reference surface disposed between and perpendicular to said first and second plane surfaces for positioning two first side surfaces of the card, said vertical card reference surface being located diagonally opposite side surfaces of said card facing said arm at said second position.

11. The card printing apparatus according to claim 1, wherein said card stock means stacks a plurality of cards in tiers.

12. The card printing apparatus according to claim 11, wherein said stock means comprises a lower plate for stocking the plurality of cards thereof in tiers and a biasing means for biasing said lower plate upwardly.

13. The card printing apparatus according to claim 11, wherein said stock means comprises a bi-sectional lower plate means for stocking the plurality of cards thereof in tiers and a biasing means for biasing each section of said bi-sectional lower plate means upwardly.

14. The card printing apparatus according to claim 1, further comprising a roller secured adjacent to the upper surface of said card stage and rotatable about an axis perpendicular to the straight linear path so as to press the card onto the upper surface of the card stage thereby.

15. The card printing apparatus according to claim 1, wherein said ejector means comprises a roller secured adjacent to the upper surface of the card stage and rotatable about an axis perpendicular to the straight linear path, and means for compulsorily rotating said roller in a direction of which the card on said card stage is ejected to said card collection zone when the card is to be ejected.

16. The card printing apparatus according to claim 1, wherein the upper surface of said card stage further comprises a vertical card reference surface disposed between and perpendicular to said first and second plane surfaces for positioning two first side surfaces of the card.

17. A card printing apparatus for printing a graphic design on the surface of a card, comprising:

a card stage adapted to mount the card on the upper surface thereof;

feeding means for feeding said card stage along a straight linear path being parallel to the upper surface thereof;

card stock means for stocking a plurality of cards;

means responsive to the feeding of said card stage for withdrawing the card from said card stock means one by one so that the card is mounted onto said card stage;

printing means for printing the graphic design on the surface of the card being mounted on said card stage; and ejector means responsive to the feeding of said card stage for ejecting the card being mounted on said card stage to a card collection zone, wherein, said ejector means comprises a roller secured adjacent to the upper surface of the card stage and rotatable about an axis perpendicular to the straight linear path, and means for preventing rotation of said roller when the card mounted on said card stage is being ejected.

18. A card printing apparatus for printing a graphic design on the surface of a card, comprising:

a card stage adapted to mount a card on the upper surface of the card stage having a first plane surface;

feeding means for feeding said card stage along a straight linear path being parallel to the upper surface thereof;

card stock means for stocking a plurality of cards;

means for withdrawing one card at a time from said card stock means so that a card is mounted onto said card stage;

printing means for printing the graphic design on the surface of the card mounted on said card stage;

lock means having an arm operative to move relative to said card stage, responsive to the feeding of said card stage, between a first position where the arm is in contact with the card on the card stage so that the card does not move along said straight linear path against said card stage and a second position where the card is allowed to move along said straight linear path against said card stage, said arm moving between said first position and said second position staying parallel to said first plane surface; and ejector means for ejecting the card mounted on said card stage to a card collection zone.

19. The card printing apparatus according to claim 18, wherein said printing means comprises a thermal print head, and a thermal transfer sheet bearing thermally transferrable printing material on the surface thereof and passing between said thermal print head and said card stage.

20. The card printing apparatus according to claim 19, wherein said printing means further comprises a thermal print head transfer means for transferring said thermal print head between a first position where said thermal print head presses said thermal transfer sheet so as to contact said thermal transfer sheet to the card mounted on said card stage and a second position where said thermal transfer head is part from said thermal transfer sheet.

21. The card printing apparatus according to claim 19, wherein said thermal print head has at least one row of thermal elements being aligned with an axis perpendicular to the straight linear path.

22. The card printing apparatus according to claim 18, wherein said arm is installed to said card stage.

23. The card printing apparatus according to claim 18, wherein said card stock means stacks a plurality of cards in tiers.

24. The card printing apparatus according to claim 23, wherein said stock means comprises a lower plate for stocking the plurality of cards thereof in tiers and a biasing means for biasing said lower plate upwardly.

25. The card printing apparatus according to claim 18, further comprising a roller secured adjacent to the upper surface of said card stage and rotatable about an axis perpendicular to the straight linear path so as to press the card onto the upper surface of the card stage thereby.

* * * * *